US007040587B2

(12) United States Patent
Thompson et al.

(10) Patent No.: US 7,040,587 B2
(45) Date of Patent: May 9, 2006

(54) ADJUSTABLE BIMINI BRACKET

(76) Inventors: David M. Thompson, 802 Mantoloking Rd., Bricktown, NJ (US) 08723; Tim Grimes, 18620 Durango La., Phillipsburg, MO (US) 65722

( * ) Notice: Subject to any disclaimer, the term of this patent is extended or adjusted under 35 U.S.C. 154(b) by 0 days.

(21) Appl. No.: 10/622,605

(22) Filed: Jul. 18, 2003

(65) Prior Publication Data

US 2005/0012004 A1 Jan. 20, 2005

(51) Int. Cl.
*A47B 96/06* (2006.01)

(52) U.S. Cl. ..... 248/214; 248/231.85; 114/361

(58) Field of Classification Search ..... 248/214, 248/229.2, 229.21, 229.26, 229.24, 229.11, 248/231.31, 231.85, 227.4, 230.1, 230.2, 248/228.1, 228.2; 211/188, 107; 16/87.2; 114/361; 135/88.01; 403/391, 400
See application file for complete search history.

(56) References Cited

U.S. PATENT DOCUMENTS 1,056,576 A * 3/1913 Olson ..... 256/35
2,405,925 A * 8/1946 Poupitch ..... 411/113
2,970,798 A * 2/1961 Friotchle et al. ..... 248/229.25
3,995,820 A * 12/1976 Einhorn ..... 248/216.1
4,736,921 A * 4/1988 Zane et al. ..... 248/316.2
5,137,243 A * 8/1992 Stevens et al. ..... 248/316.7
5,161,909 A * 11/1992 Crouse et al. ..... 403/391
5,295,727 A * 3/1994 Kao ..... 297/215.14
5,395,018 A * 3/1995 Studdiford ..... 224/420
5,464,187 A * 11/1995 Linkner, Jr. ..... 248/635
D392,180 S * 3/1998 Bilow ..... D8/395
5,782,040 A * 7/1998 McCartan ..... 52/98
6,390,436 B1 * 5/2002 Barnes et al. ..... 248/548
6,672,241 B1 * 1/2004 Warfel et al. ..... 114/361
6,685,385 B1 * 2/2004 Ledingham ..... 403/400

* cited by examiner

*Primary Examiner*—Anita M. King
(74) *Attorney, Agent, or Firm*—Andrew W. Ludy

(57) ABSTRACT

An adjustable bimini bracket is for use in connection with a boat having a railing tubular member on either side of the boat, and a bimini having strut tubular members. Left and right side plates are generally parallel and spaced apart. A transverse plate extends between the side plates. Ridges are disposed intermediate the transverse plate and the end. The side plates have a pair of collinear holes therethrough adjacent each end. The bimini bracket will slidingly engage the tubular member between the side plates. A bolt and a hand knob engage the first holes. The hand knob will be tightened, clamping the tubular member between the side plates, thereby preventing the bimini bracket from sliding on the tubular member. A second bolt and a nut engage the second holes for pivotal fastening of a strut tubular member to the bimini bracket, and for fastening a tie-down. The side plates taper upward in thickness from one end to the ridges. A plurality of ribs reinforces the side plates.

5 Claims, 3 Drawing Sheets

ADJUSTABLE BIMINI BRACKET

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the field of boat bimini tops, and more particularly to an adjustable mounting bracket for mounting an awning, or bimini, on a boat. The popularity of boating has resulted in a proliferation of sizes and styles of boats, with a consequent need for mounting options for bimini tops. Seating and control console arrangements differ greatly, and the bimini must be positioned to shield the boat occupants from sun and rain. When it is not needed, the bimini is folded for storage. This usually involves supporting the folded bimini at an angle over the seats by erecting support posts. The propped-up bimini then becomes an obstruction to view, drips water after a rain, interferes with the casting of a fishing line, and can even fall down and injure someone. In order to stow the folded bimini behind the aftermost seats, the whole bimini assembly must be able to slide aft. Heretofore, this required a pair of tracks; one mounted on each side of the boat, and related special hardware. This hardware is an expensive option, and is seldom installed. Adjusting the mounting position of struts and tie-down straps meant loosening the mounting brackets with a screwdriver and wrench, sliding the bracket on the square tubing frame or handrail, and then re-tightening the brackets. This process is so time-consuming and troublesome, that these brackets are adjusted once, and not touched again. Thus, if the boat is moored or anchored, and the hot sun is uncomfortable, there is no easy way to reposition the bimini for shelter, then later restore it's position for operating the boat.

Accordingly, there is a need to provide a bimini bracket that can be quickly and easily loosened, slidingly adjusted along a strut or handrail, and then quickly and securely tightened.

There is a further need to provide a bimini bracket of the type described and that will allow the entire bimini assembly to be moved forward or aft for repositioning or storage.

There is a yet further need to provide a bimini bracket of the type described and that will allow the entire bimini assembly to be rotated for optimal sheltering position.

There is a still further need to provide a bimini bracket of the type described and that is simple to operate and rugged for long service life.

There is another need to provide a bimini bracket of the type described and that can be manufactured cost-effectively in large quantities of high quality.

BRIEF SUMMARY OF THE INVENTION

In accordance with the present invention, there is provided an adjustable bimini bracket, for use in connection with a boat having a railing tubular member on either side of the boat. The boat is equipped with a bimini having a top, a plurality of tie-downs, and a plurality of strut tubular members. Each strut tubular member has at least one terminus. The bimini bracket comprises a left side plate and a right side plate, which are generally parallel and spaced apart. The left and right side plates extend between opposite first and second ends. The left and right side plates each have a first hole therethrough adjacent the first end, the first holes being collinear. The side plates also have a second hole through each plate adjacent the second end, the second holes being collinear. A transverse plate extends between the left and right side plates intermediate the first and second ends. Thus, the bimini bracket will slidingly engage the tubular member between the left and right side plates, and adjacent the transverse plate.

A biasing means is provided for biasing the first ends of the left and right side plates toward one another. The biasing means includes a first bolt and a hand knob engaging the first holes. One of the first holes includes a first shaped recess therein to receive a similarly shaped member on the head of the first bolt. The biasing means is hand operated, so that the biasing means will be hand tightened. This will clamp the tubular member between the left and right side plates, thereby preventing the bimini bracket from sliding on the tubular member. Similarly, the biasing means will be hand loosened, allowing the bimini bracket to slide on the tubular member.

A fastening means is provided adjacent the second ends of the left and right side plates, for pivotal fastening of the terminus of one of the strut tubular members to the bimini bracket, and for fastening one of the tie-downs to the bimini bracket. The fastening means includes a second bolt and a nut engaging the second holes. One of the second holes includes a second shaped recess therein to receive a similarly shaped member on the head of the second bolt.

BRIEF DESCRIPTION OF THE SEVERAL VIEWS OF THE DRAWING

A more complete understanding of the present invention may be obtained from consideration of the following description in conjunction with the drawing, in which.

DETAILED DESCRIPTION OF THE INVENTION

Figure 1:
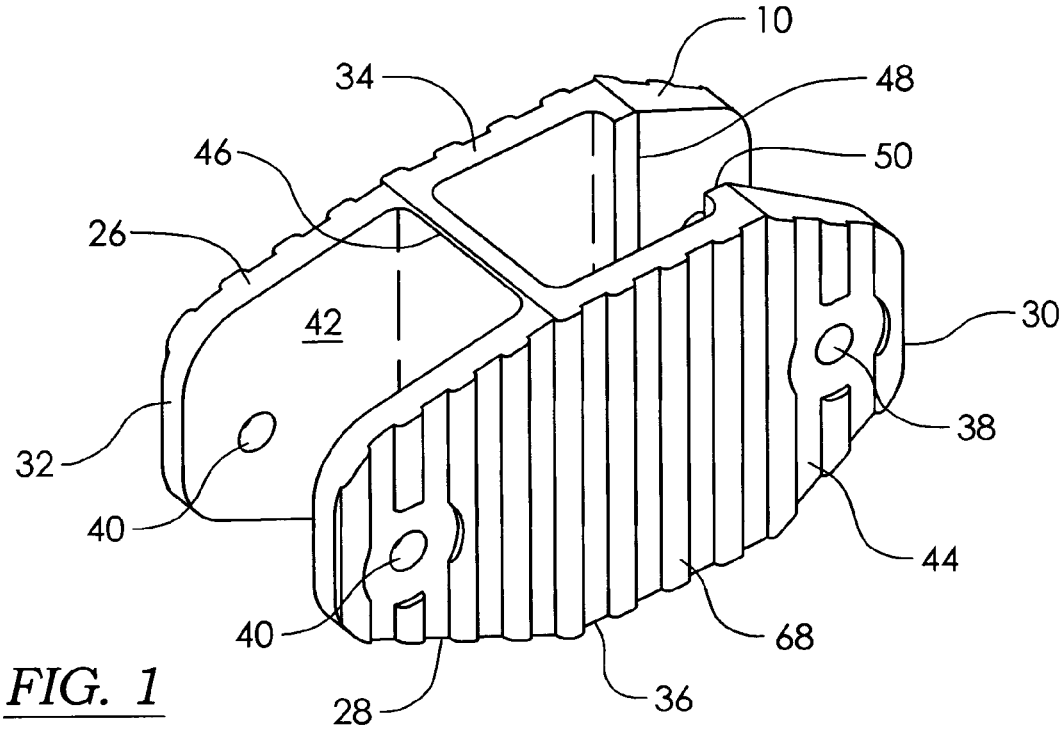
FIG. 1 is a perspective view of an adjustable bimini bracket constructed in accordance with the invention.
Figure 2:
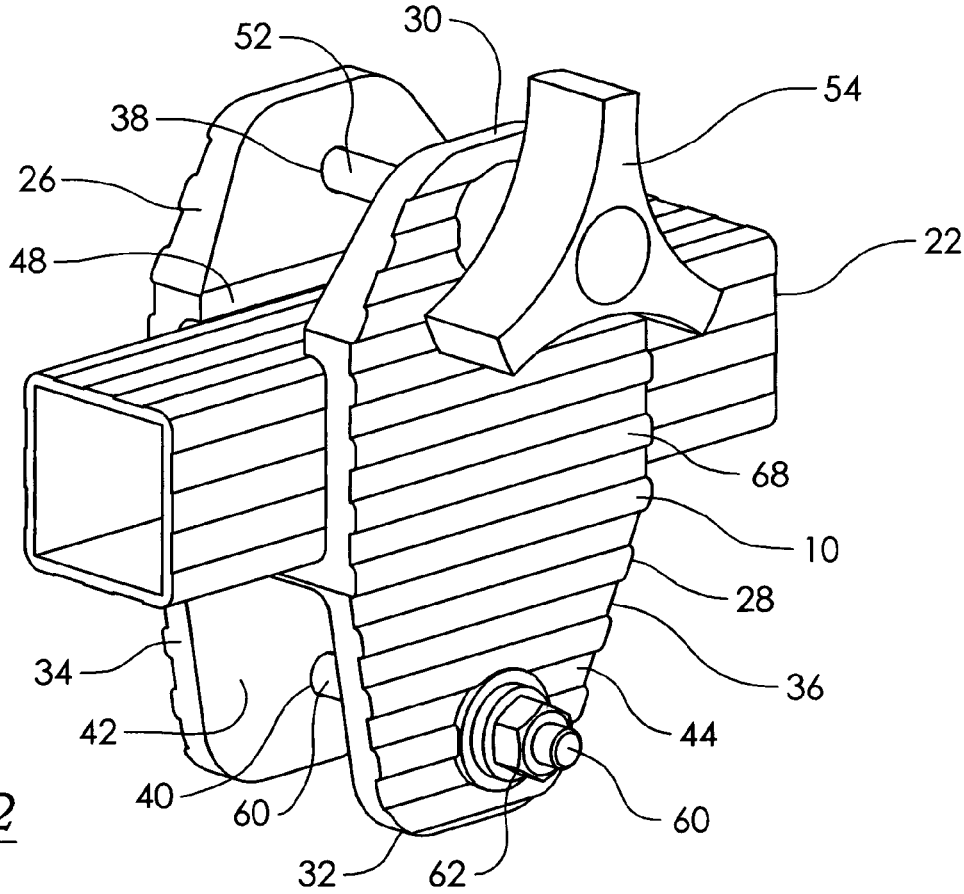
FIG. 2 is another perspective view of the bimini bracket of FIG. 1, showing associated hardware.
Figure 3:
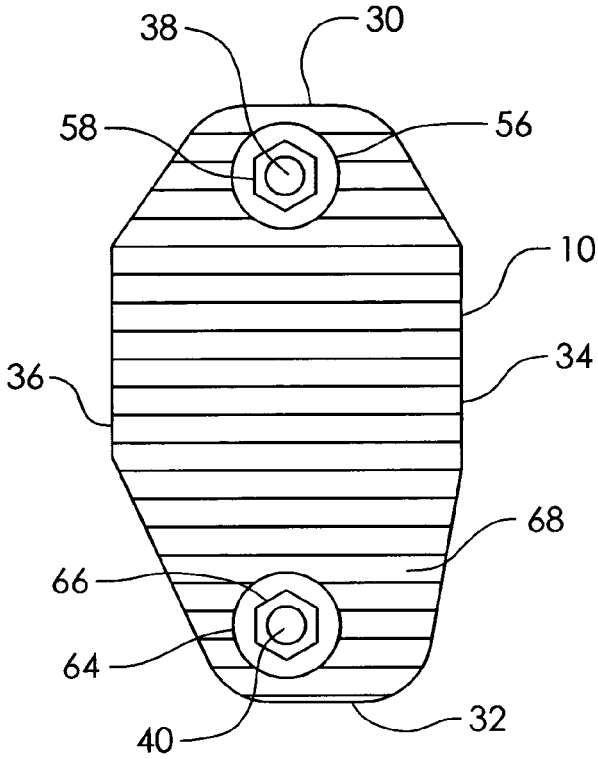
FIG. 3 is a left side elevational view of the bimini bracket of FIG. 1.
Figure 4:
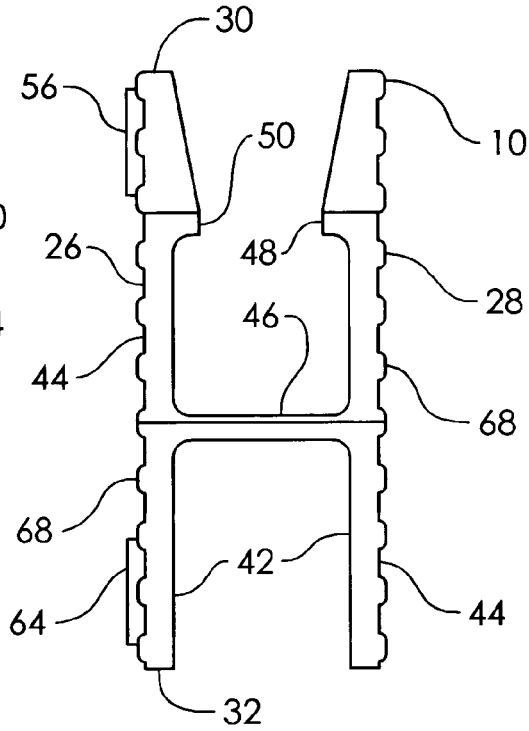
FIG. 4 is a front elevational view of the bimini bracket of FIG. 1.

Referring now to the drawing, an adjustable bimini bracket is shown at 10, and is for use in connection with a boat 12 having a railing tubular member 14 on either side of the boat 12. The boat 12 is equipped with a bimini 16 having a top 18, a plurality of tie-downs 20, and a plurality of strut tubular members 22. Each strut tubular member 22 has at least one terminus 24. The bimini bracket 10 comprises a left side plate 26 and a right side plate 28, which are generally parallel and spaced apart. The left 26 and right 28 side plates extend between opposite first 30 and second 32 ends. The left 26 and right 28 side plates extend between opposite front 34 and rear 36 edges. The left 26 and right side 28 plates each have a first hole 38 therethrough adjacent the first end 30, the first holes 38 being collinear. The side plates 26 and 28 also have a second hole 40 through each plate adjacent the second end 32, the second holes 40 being collinear. The left 26 and right 28 side plates each have an inner surface 42 and an outer surface 44.

A transverse plate 46 extends between the left 26 and right 28 side plates intermediate the first 30 and second 32 ends. The transverse plate 46 extends from adjacent the front edge 34 to adjacent the rear 36 edge. A left ridge 48 is provided on the left plate inner surface 42, and a right ridge 50 is provided on the right plate inner surface 42. The left 48 and right 50 ridges are disposed intermediate the transverse plate 46 and the first end 30. The left 26 and right 28 side plates taper upward in thickness from the first end 30 to the ridges 48 and 50, to reinforce the side plates 26 and 28 adjacent the first end 30. The left 48 and right 50 ridges extend from adjacent the front edge 34 to adjacent the rear edge 36. Thus, the bimini bracket 10 will slidingly engage the tubular member 14 or 22 between the left 26 and right 28 side plates, and between the transverse plate 46 and the left 48 and right 50 ridges.

A hand operated biasing means is provided for biasing the first ends 30 of the left 26 and right 28 side plates toward one another. The biasing means includes a first bolt 52 and a hand knob 54 engaging the first holes 38. A first boss 56 is juxtaposed with one of the first holes 38. The first boss 56 has a first hexagonal recess 58 therein aligned with the first hole 38 to receive the head of the first bolt 52, so as to resist turning of the first bolt 52 while turning the hand knob 54. The hand knob 54 will be hand tightened, clamping the tubular member 14 or 22 between the left 26 and right 28 side plates, thereby preventing the bimini bracket 10 from sliding on the tubular member. Similarly, the hand knob 54 will be hand loosened, allowing the bimini bracket 10 to slide on the tubular member 14 or 22.

A fastening means is provided adjacent the second ends 32 of the left 26 and right 28 side plates, for pivotal fastening of the terminus 24 of one of the strut tubular members 22 to the bimini bracket 10, and alternately for fastening one of the tie-downs 20 to the bimini bracket 10. The fastening means includes a second bolt 60 and a nut 62 engaging the second holes 40. A second boss 64 is juxtaposed with one of the second holes 40. The second boss 64 has a second hexagonal recess 66 therein aligned with the second hole 40 to receive the head of the second bolt 60, so as to resist turning of the second bolt 60 while turning the nut 62.

A plurality of ribs 68 is provided on the outer surfaces of the left and right side plates. The ribs 68 extend between the front 34 and rear 36 edges, to reinforce the side plates 26 and 28.

Figure 5:
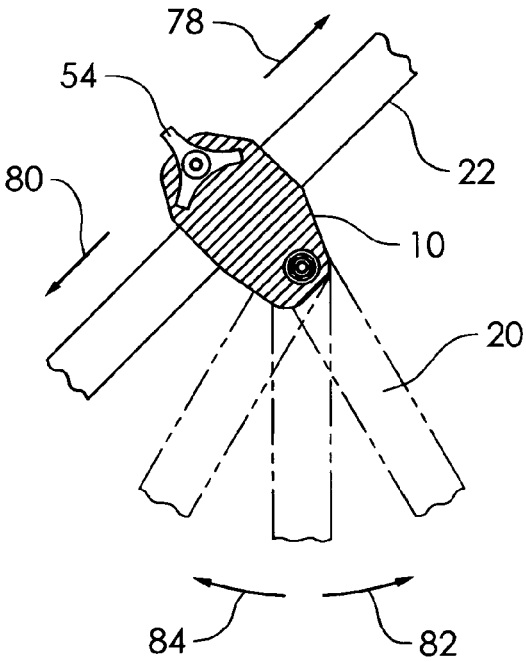
FIG. 5 is a right side elevational view of the bimini bracket of FIG. 1, showing the bracket mounted for use.
Figure 6:
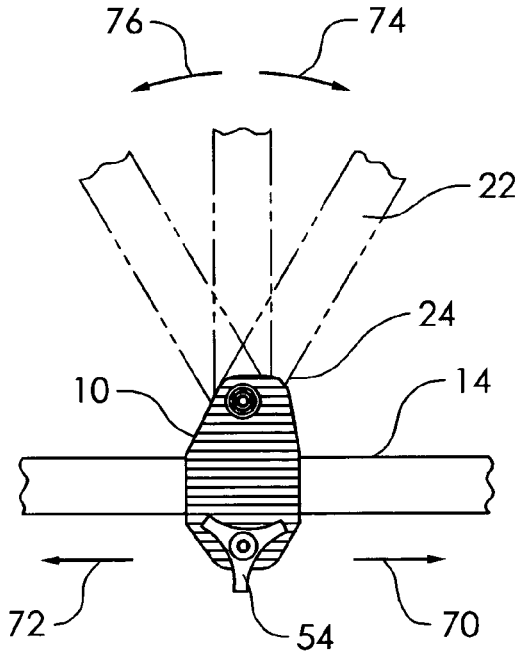
FIG. 6 is another right side elevational view of the bimini bracket of FIG. 1, showing the bracket mounted for use.
Figure 7:
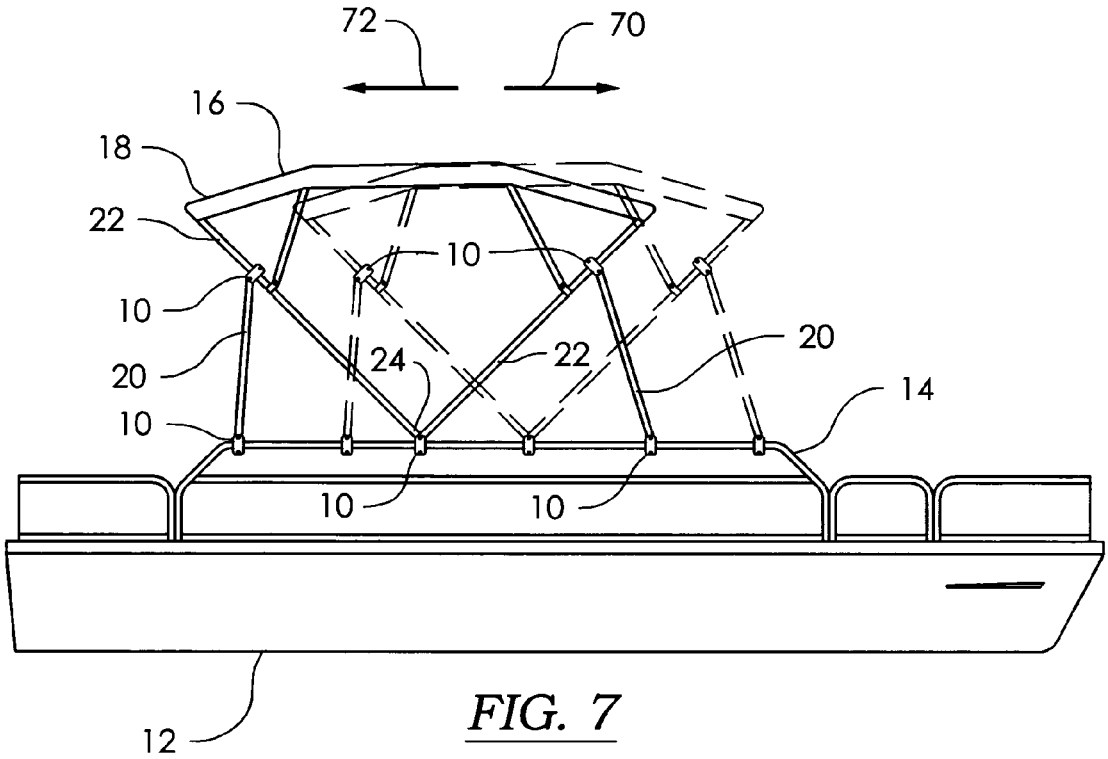
FIG. 7 is a starboard side elevational view of a boat, showing the bimini bracket of FIG. 1 in use on a bimini.
Figure 8:
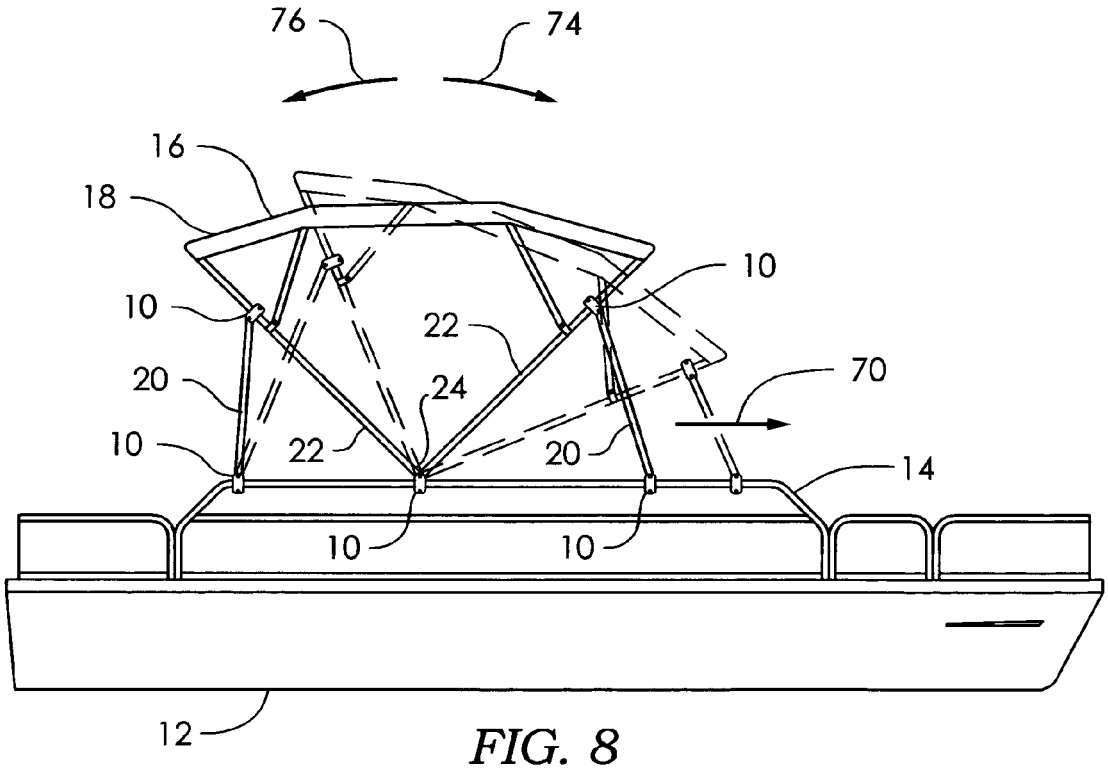
FIG. 8 is another starboard side elevational view of a boat, showing the bimini bracket of FIG. 1 in use on a bimini.

In use, the bimini brackets 10 mounting the bimini 16 to the railing tubular member 14 can be loosened, as shown in FIGS. 6 and 7. This will allow sliding movement of the bimini 16 forward in the direction of arrow 70, or aft in the direction of arrow 72. The bimini 16 can be rotated, as shown in FIGS. 6 and 8. Forward rotation is depicted in the direction of arrow 74, and aft rotation in the direction of arrow 76. As illustrated in FIG. 5, adjustments can be made to a tie-down 20 by sliding the bracket 10 along the strut tubular member 22 upward in the direction of arrow 78, or downward in the direction of arrow 80. The tie-down 20 can be shifted forward and aft as in arrows 82 and 84 respectively.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

The embodiments of the invention in which an exclusive property or privilege is claimed are defined as follows:

1. An adjustable bimini bracket, for use in connection with a boat having a railing tubular member on either side of the boat, the railing tubular member having a central axis and a generally rectangular cross-section, and a bimini having a top, a plurality of tie-downs, and a plurality of strut tubular members, each strut tubular member having a central axis and a generally rectangular cross-section and at least one terminus, the bimini bracket comprising:

(a) a left side plate and a right side plate, the left and right side plates being generally flat, generally parallel and spaced apart, the left and right side plates extending between opposite first and second ends, the left and right side plates extending between opposite front and rear edges, the left and right side plates each having a first hole therethrough adjacent the first end, the first holes being collinear, the left and right side plates each having a second hole therethrough adjacent the second end, the second holes being collinear, the left and right side plates each having an inner surface and an outer surface;

(b) a transverse plate extending between the left and right side plates intermediate the first and second ends, the transverse plate being generally flat, the transverse plate extending from adjacent the front edge to adjacent the rear edge;

(c) a left ridge on the left plate inner surface, and a right ridge on the right plate inner surface, the left and right ridges being disposed intermediate the transverse plate and the first end, the left and right ridges being parallel to the central axis, the left and right ridges extending from adjacent the front edge to adjacent the rear edge, the left plate inner surface, the right plate inner surface, the transverse plate, and the left and right ridges defining a generally rectangular cross-sectional cavity for allowing the bimini bracket to slide in an axial direction along engage the tubular member between the left and right side plates, and between the transverse plate and the left and right ridges, while preventing the bimini bracket from rotating about the central axis;

(d) a first bolt and a hand knob engaging the first holes, for allowing the tubular member to be clamped between the left and right side plates when the hand knob is hand tightened, thereby preventing the bimini bracket from sliding on the tubular member, and for allowing the bimini bracket to slide on the tubular member when the hand knob is hand loosened;

(e) a second bolt and a nut engaging the second holes, for pivotal fastening of the terminus of one of the strut tubular members to the bimini bracket, and for fastening one of the tie-downs to the bimini bracket; and (f) a first boss juxtaposed with one of the first holes, the first boss having a first recess therein aligned with the first hole to receive the head of the first bolt, so as to resist turning of the first bolt while turning the hand knob.

2. The bimini bracket of claim 1, further comprising a second boss juxtaposed with one of the second holes, the second boss having a second recess therein aligned with the second hole to receive the head of the second bolt, so as to resist turning of the second bolt while turning the nut.

3. The bimini bracket of claim 2, wherein the left and right side plates taper upward in thickness from the first end to the ridges, to reinforce the side plates adjacent the first end.

4. The bimini bracket of claim 3, further comprising a plurality of ribs on the outer surfaces of the left and right side plates, the ribs extending between the front and rear edges, to reinforce the side plates.

5. An adjustable bimini bracket, for use in connection with a boat having a railing tubular member on either side of the boat, and a bimini having a top, a plurality of tie-downs, and a plurality of strut tubular members, each strut tubular member having at least one terminus, the bimini bracket comprising:

(a) a left side plate and a right side plate, the left and right side plates being generally parallel and spaced apart, the left and right side plates extending between opposite first and second ends, the left and right side plates extending between opposite front and rear edges, the left and right side plates each having a first hole therethrough adjacent the first end, the first holes being collinear, the left and right side plates each having a second hole therethrough adjacent the second end, the second holes being collinear, the left and right side plates each having an inner surface and an outer surface;

(b) a transverse plate extending between the left and right side plates intermediate the first and second ends, the transverse plate extending from adjacent the front edge to adjacent the rear edge;

(c) a left ridge on the left plate inner surface, and a right ridge on the right plate inner: surface, the left and right ridges being disposed intermediate the transverse plate and the first end, the left and right side plates tapering upward in thickness from the first end to the ridges, to reinforce the side plates adjacent the first end, the left and right ridges extending from adjacent the front edge to adjacent the rear edge, for allowing the bimini bracket to slidingly engage the tubular member between the left and right side plates, and between the transverse plate and the left and right ridges;

(d) a first bolt and a hand knob engaging the first holes, for allowing the tubular member to be clamped between the left and right side plates when the hand knob is hand tightened, thereby preventing the bimini bracket from sliding on the tubular member, and for allowing the bimini bracket to slide on the tubular member when the hand knob is hand loosened;

(e) a second bolt and a nut engaging the second holes, for pivotal fastening of the terminus of one of the strut tubular members to the bimini bracket, and for fastening one of the tie-downs to the bimini bracket;

(f) a first boss juxtaposed with one of the first holes, the first boss having a first hexagonal recess therein aligned with the first hole to receive the head of the first bolt, so as to resist turning of the first bolt while turning the hand knob;

(g) a second boss juxtaposed with one of the second holes, the second boss having a second hexagonal recess therein aligned with the second hole to receive the head of the second bolt, so as to resist turning of the second bolt while turning the nut; and (h) a plurality of ribs on the outer surfaces of the left and right side plates, the ribs extending between the front and rear edges, to reinforce the side plates.

* * * * *